US005711225A

United States Patent [19]

Rasmussen

[11] Patent Number: 5,711,225

[45] Date of Patent: Jan. 27, 1998

[54] METHOD FOR PROCESSING A CONTINUOUS WEB EXTENDING ALONG A PREDETERMINED PATH

[75] Inventor: Torben Rasmussen, Hvidovre, Denmark

[73] Assignee: Nilpeter a/s, Slagelse, Denmark

[21] Appl. No.: 687,536

[22] PCT Filed: Jan. 30, 1995

[86] PCT No.: PCT/DK95/00043

§ 371 Date: Jul. 30, 1996

§ 102(e) Date: Jul. 30, 1996

[87] PCT Pub. No.: WO95/20488

PCT Pub. Date: Aug. 3, 1995

[30] Foreign Application Priority Data

Jan. 31, 1994 [DK] Denmark ..... 0130/94

[51] Int. Cl.[6] ..... B41F 13/54

[52] U.S. Cl. ..... 101/483; 101/181; 101/228

[58] Field of Search ..... 101/228, 219, 101/181, 211, 483

[56] References Cited

U.S. PATENT DOCUMENTS

| | | | |
|---|---|---|---|
| 3,049,078 | 8/1962 | Smith, Jr. | 10/228 |
| 3,762,322 | 10/1973 | Vines | 101/228 |
| 4,541,335 | 9/1985 | Tokuno et al. | 101/181 |
| 4,592,278 | 6/1986 | Tokuno et al. | 101/181 |
| 4,658,723 | 4/1987 | Tokuno et al. | 101/181 |
| 4,966,075 | 10/1990 | Brian | 101/211 |

FOREIGN PATENT DOCUMENTS

| | | | |
|---|---|---|---|
| 0407369 | 1/1923 | Germany . | |
| 0610817 | 5/1979 | Switzerland | B41F 13/04 |
| 94/16892 | 8/1994 | WIPO | B41F 7/02 |

*Primary Examiner*—Edgar S. Burr
*Assistant Examiner*—Dave A. Ghatt
*Attorney, Agent, or Firm*—Klein & Szekeres, LLP

[57] ABSTRACT

A method and a cylinder arrangement for a printing apparatus is provided in which printing plates (16,17) or punching plates (16,17) of different lengths may selectively be mounted on the same plate cylinder (12,13), and wherein a web (10) to be printed or punched may be moved past the cylinder (12,13) at a substantially constant speed. Two or more formats (18,19) may be interlaced on the web (10). The formats (18, 19) may be of different lenghts in the longitudinal direction of the web (10). Adjustment means for adjusting web length between printing units or between contact points between the web (10) and plates (16,17) within the same printing unit are not needed.

8 Claims, 2 Drawing Sheets

METHOD FOR PROCESSING A CONTINUOUS WEB EXTENDING ALONG A PREDETERMINED PATH

BACKGROUND OF THE INVENTION

The present invention relates to a method of processing a continuous web extending along a predetermined path, for example in a printing machine.

A printing machine should preferably be able to produce different formats of printed matter having different lengths or dimensions in the longitudinal direction of the web. Alternatively or additionally, the printing machine should be able to punch different formats of printed matter, such as labels and the like, having different lengths or dimensions in the longitudinal directions of the web from said web.

Conventionally, the problem is solved by exchanging the printing cylinders or punching cylinders so that the printing and/or punching cylinder used has a peripheral length corresponding to the length or longitudinal dimension of the format to be printed.

For example from U.S. Pat. No. 4,592,278 and Swiss Patent No. 610 817 a printing apparatus is known in which the same printing cylinder or plate cylinder may be used for printing plates covering only part of the circumferential length of the cylinder. In order to secure that the formats printed on the paper web passing through the printing apparatus are closely spaced the web is passed around a horizontally moveable adjuster roller. By moving the adjuster roller the movement of the web may be stopped when the printing plate is out of engagement with the web while the web is being moved at a uniform speed when the printing plate mounted on the plate cylinder is in engagement therewith.

A web printing apparatus with printing plate cylinder and web speed control is disclosed in U.S. Pat. No. 4,541,335 wherein the plate cylinders are adapted to carry two identical plates. By this arrangement, two formats printed on the web with the first plate are followed by two formats printed on the web with the second plate etc. The web is guided in such a way that the length of web existing between two contact points between the web and the plates of the plate cylinder is three or more odd number of times as long as the printing length. Thereby, the formats may be closely spaced by controlling the rotational speed of the printing cylinder so that the rotational speed is decreased when the printing plate is out of engagement with the web while it is maintained at a constant level corresponding to the speed of the web when the printing plate mounted on the plate cylinder is in engagement with the web. Between adjacent printing units, web length adjusting units are needed for adjusting the length of web existing between the adjacent printing units to the printing length multiplied by an integer.

In DE-C-407369 a printing apparatus is disclosed for printing consecutive formats on a web either in two colours on one side of the web, or in one colour on both sides of the web, or in one colour and on one side of two separate webs. Formats printed on a web by the disclosed printing apparatus is printed alternately from identical printing plates mounted on two separate printing cylinders. However, the circumference of a printing cylinder has to be equal to twice the length of the printing plate mounted on it and the diameter of the corresponding impression cylinder has to be equal to twice the diameter of the printing cylinder. Thus, the cylinder arrangement disclosed can not be used for printing formats of different lengths without exchanging the impression cylinders and printing cylinders.

SUMMARY OF THE INVENTION

The present invention provides a method and a cylinder arrangement for a printing apparatus in which printing plates or punching plates of different lengths may selectively be mounted on the same plate cylinder, and wherein the web to be printed or punched may be moved past the cylinder at a substantially constant speed.

It is an advantageous feature of the present invention that two or more formats may be interlaced on the web and that the formats may be of different lengths in the longitudinal direction of the web.

It is an another advantageous feature of the present invention that adjustment means for adjusting web length between printing units or between contact points between the web and plates within the same printing unit are not needed. This feature reduces the time and effort used by the operator of the printing apparatus when exchanging plates of the plate cylinders between printing jobs as no adjustments of web lengths are required. The web path need not be changed and adjusted.

It is still another advantageous feature of the present invention that each plate cylinder may carry one plate only, whereby the diameter and accordingly the mass and moment of inertia of the plate cylinder are minimized.

It is a further advantage of the present invention that the tension of the web is minimized as the speed of the web is kept constant during printing.

Thus, the present invention provides a method of processing a continuous web extending along a predetermined path by means of at least first and second printing or punching plates mounted on first and second plate cylinders, respectively, mutually spaced along the length of said path, the first and second plates each extending along only part of the circumferential length of the cylinder on which it is mounted, said method comprising the steps of moving the continuous web along said path, moving the first cylinder such that the first printing or punching plate mounted thereon is moved into and out of engagement with the moving web so as to print or punch first formats on the web by means of the first printing or punching plate such that the first formats are mutually spaced in the direction of movement of the web, moving the second cylinder such that the second printing or punching plate mounted thereon is moved into and out of engagement with the moving web so as to print or punch second formats on the web in the spacings between said first formats by means of the second printing or punching plate, controlling the circumferential speed of the first and second plate cylinders to be substantially equal to the moving speed of the web while the first and second plates, respectively, mounted on said first and second cylinders are in engagement with the web, and controlling the circumferential speed of the first and second plate cylinders while the first and second plates, respectively, are out of engagement with the web in such a way that the leading edge of the respective plate comes into the correct angular position for engagement with the web at the desired position in relation to the position where the trailing edge of the other plate moves out of engagement with the web to print or punch first and second formats on the web with a desired mutual spacing.

Each of the first and second cylinders are rotated intermittently. Thus, when the first printing or punching plate is in engagement with the web the first plate cylinder is rotated at such a rotational speed that the circumferential speed of the first printing or punching plate corresponds substantially to the speed of movement of the web. However, when the trailing edge of the first printing or punching plate has been moved out of engagement with the web the rotational speed of the cylinder is changed, for example increased or reduced, or the rotation of the cylinder may even be stopped for a short while to secure that the leading edge of the plate comes into the correct angular position for engagement with the web at the right moment. Thereafter the first cylinder is again rotated at such a rotational speed that the circumferential speed or velocity of the first printing or punching plate corresponds to the speed of the web. The rotational movement of the first cylinder may be controlled so that the first formats being printed or punched are mutually spaced at a distance which is substantially equal to the circumferential length of the second printing or punching plate mounted on the second plate cylinder. Similarly, the second plate cylinder is rotated intermittently, and the rotational speed of the second cylinder is controlled such that the circumferential speed of the second printing or punching plate is substantially the same as the speed or velocity of the web when the plate is in engagement therewith, and such that the second printing or punching plate prints or punches second formats in the spacings between the first formats printed or punched by the first printing or punching plate mounted on the first cylinder.

There may be any desired mutual spacing between the first and second formats printed on or punched from the web. Preferably, however, the mutual spacing of the first formats is substantially equal to the length of each second format in the direction of the movement of the web so that the first and second formats are arranged closely adjacent on the web.

In the method according to the invention it is possible to move the web along its predetermined path at a varying velocity or speed provided that the rotational speeds of the first and second plate cylinders are controlled so that when the first and second printing or punching plates are in engagement with the web, each such plate has a circumferential speed substantially equal to the speed or velocity of the web. In the preferred embodiment, however, the web is moved along its path at a substantially constant, uniform speed or velocity.

The minimum length of the web path section defined between the web contact lines of the first and second plates is determined by the radii of the plate cylinders. In the preferred embodiment, however, the length of said web section exceeds several times the combined lengths of the first and second formats.

It should be understood, that in the method according to the present invention more than two plate cylinders could be used. Thus, the rotational movement of the first cylinder could be controlled so that the mutual spacing between the first formats being printed or punched is not only the length of the second format, but also the length of a third and possibly one or more further formats. A third and possibly further plate cylinders could then be arranged along the path of the web for carrying third and possibly further printing or punching plates.

The present invention also provides a cylinder arrangement for a printing apparatus and for printing or punching on a continuous web being moved along a predetermined path defined in the apparatus, said arrangement comprising at least first and second plate cylinders being arranged mutually spaced along the path of the web, each cylinder being adapted to receive a printing or punching plate extending along only part of the circumferential length of the cylinder between first and second circumferential positions thereof, moving means for rotating the first and second cylinders so as to move the plates mounted thereon into and out of engagement with the moving continuous web, and control means for controlling the moving means in such a way that the circumferential speed of the first and second plate cylinders is substantially equal to the moving speed of the web while the first and second plates, respectively, mounted on said first and second cylinders are in engagement with the web, and in such a way that the leading edge of the respective plate of the first and second plate cylinders while the first and second plates, respectively, are out of engagement with the web comes into the correct angular position for engagement with the web at the desired position in relation to the position where the trailing edge of the other plate moves out of engagement with the web, so as to print or punch first formats on the web by means of the first printing or punching plate such that the first formats are mutually spaced in the direction of movement of the web at a predetermined distance being at least equal to the circumferential length of the second printing or punching plate mounted on the second cylinder, and so as to print or punch second formats on the web in the spacings between said first formats by means of the second printing or punching plate mounted on the second cylinder.

The control means may be adapted to control the circumferential speed of the first and second cylinders so that it is substantially equal to the moving speed of the web along the predetermined path when the plate mounted on the respective cylinder is in engagement with the web. The control means may receive signals from means currently detecting velocity or speed of the web and signals from means detecting the angular position of each of the first and second cylinders.

It may be desirable to adjust the length of the web section defined between the contact lines between each of the first and second plates and the web. Therefore, the cylinder arrangement may comprise means for adjusting the length of the web path section defined between the first and second cylinders. These adjusting means may comprise web engaging means arranged between the first and second cylinders and being moveable transversely to the path of the web so that the said web path section may be loop-shaped. The web engaging means may comprise a pair of rollers, and the web may be passed through the nip of these rollers.

BRIEF DESCRIPTION OF THE DRAWINGS

The invention will now be further described with reference to the drawings, wherein.

DETAILED DESCRIPTION OF A PREFERRED EMBODIMENT

Figure 1:
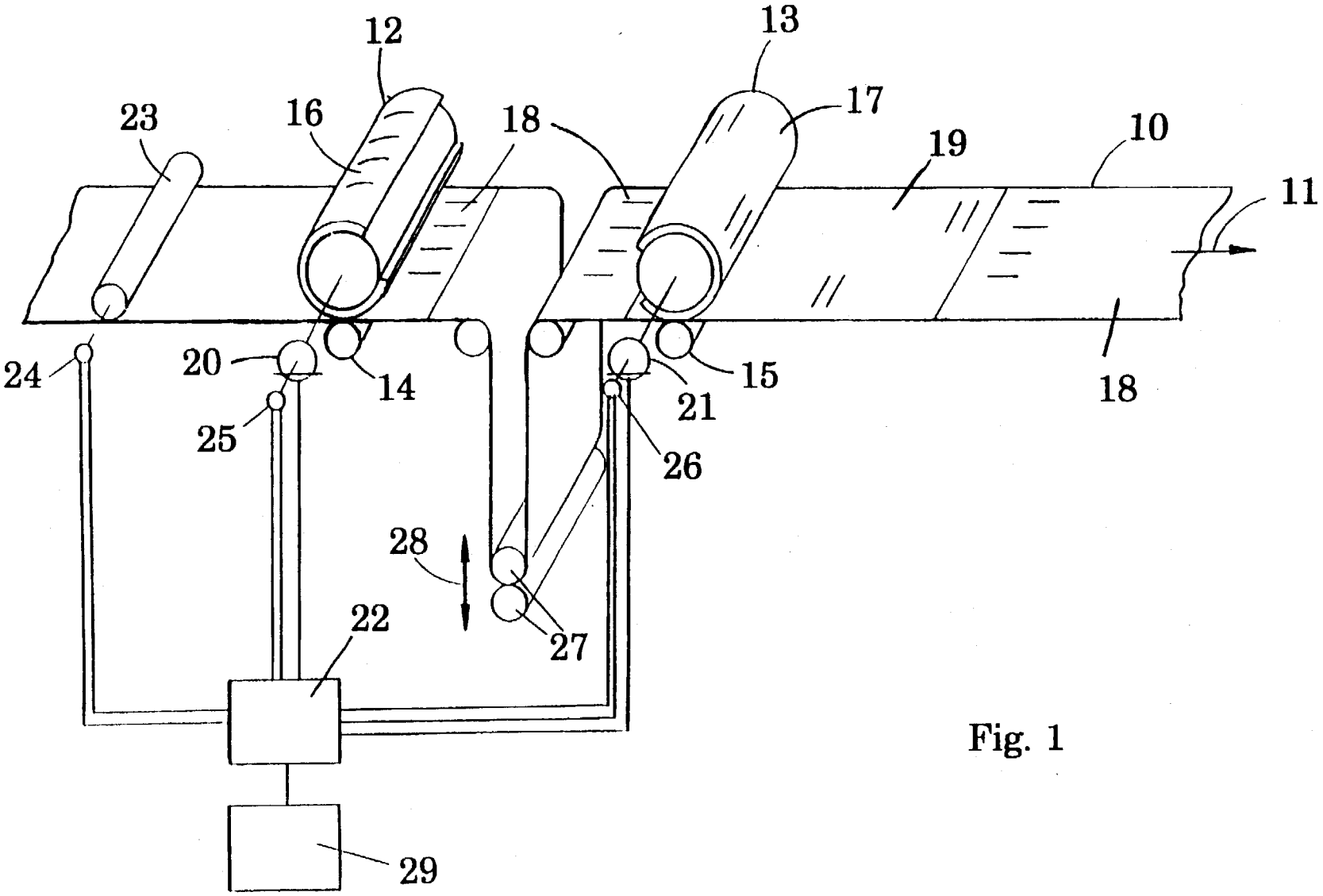
FIG. 1 is a diagrammatic perspective view of an embodiment of the cylinder arrangement according to the invention.

FIG. 1 diagrammatically illustrates a cylinder arrangement which may, for example, form part of a printing machine or printing apparatus for printing formats on and possibly also for punching or die-cutting printed formats from a web 10 made from paper, plastic or a similar material. The web 10 is moved at a substantially constant velocity or speed indicated by an arrow 11, along a predetermined path, which is defined by cylinders, rollers and similar guide members in a conventional manner.

The cylinder arrangement comprises a pair of plate cylinders 12 and 13 which are longitudinally spaced along the length of the web 10. Each of the cylinders 12 or 13 cooperate with an impression cylinder designated 14 and 15, respectively, and the web 10 is passed through the nips between the cylinders 12 and 14 and 13 and 15, respectively. A printing or punching plate 16 and 17 may be mounted on the circumferential outer surface of the plate cylinders 12 and 13, respectively, and as best shown in FIG. 1 the circumferential length of each of the plates 16 and 17 is shorter that the circumference of the associated cylinder.

The first printing or punching plate 16 may print on or punch from the moving web 10 a plurality of mutually spaced first formats 18. The length of each first format 18 in the longitudinal direction of the web 10 is equal to the circumferential length of the printing or punching plate 16, and the mutual longitudinal spacing of the first formats 18 is preferably substantially equal to the circumferential length of the printing or punching plate 17 mounted on the plate cylinder 13. The rotational movement of the plate cylinder 13 is controlled so that a second format 19 is printed in each spacing between the first formats 18. The first and second formats 18 and 19 may be different, but they may also be identical.

The plate cylinders 12 and 13 may be driven by means of electric motors 20 and 21, respectively, which are controlled by an electronic control device or controller 22. A feed or guide roller 23 which is arranged in contact with the web 10 upstream of the plate cylinders 12 and 13 has a circumferential speed which is equal to the speed of movement of the web 10 which means that the rotational speed of the guide roller 23 indicates the speed of the web 10. The control device 22, which may, for example be a microcomputer, controls the speed of the web 10 and the rotational speed of the cylinders 12 and 13 via the electric motors 20 and 21 based on signals received from detecting means 24 driven by the shaft of the feed or guide roller 23, and from detecting means 25 and 26 which are driven by the shafts of the plate cylinders 12 and 13, respectively.

Each of the detecting means or encoders 24–26may, for example, comprise a pulse generator having a pair of outputs. One of the outputs may generate a pulse for each incremental angular movement of the shaft of the encoder or cylinder whereby the angular position of the shaft may be determined by monitoring the pulses received from the detecting means or encoders. Also the angular speed may be determined by dividing the number of pulses in a pulse train by the time duration of such train. At the other output the detecting means or encoders 24–26 may generate a pulse each time the shaft is in a predetermined angular position whereby the control device 22 may at any time determine the angular position of the respective shaft of the cylinder or roller by combining the information received through pulses from the two outputs. Based upon the information received from the detecting means 24–26 the control device 22 may individually control the rotational speed of the plate cylinders 12 and 13 in relation to the speed of movement of the web 10 such that the circumferential speed of the printing or punching plates 16 and 17 are the same as the speed or velocity of the web 10 when the plates are in contact with the web and so that the formats 18 and 19 are printed or punched alternatingly as described above. While the circumferential speed of the plate cylinders 12 and 13 has to be the same as the speed of movement of the web 10 when the plates are in engagement with the web, the rotational speed of each cylinder must be changed when the plate is out of engagement with the web so as to restart printing or punching or die-cutting at exactly the right position of the web 10.

The cylinder arrangement may also comprise a pair of adjustment rollers 27 positioned between the cylinders 12 and 13 and defining a nip therebetween through which the web 10 is passed. This pair of rollers 27 may be moved vertically or transversely to the path of the web 10 as indicated by an arrow 28 in FIG. 1. By moving the pair of rollers 27 the length of the loop-shaped web section extending between the cylinders 12 and 13 may be adjusted. Adjusting movement of the pair of rollers 27 may be performed manually or may be automatically controlled by the electronic control device 22.

Figure 2:
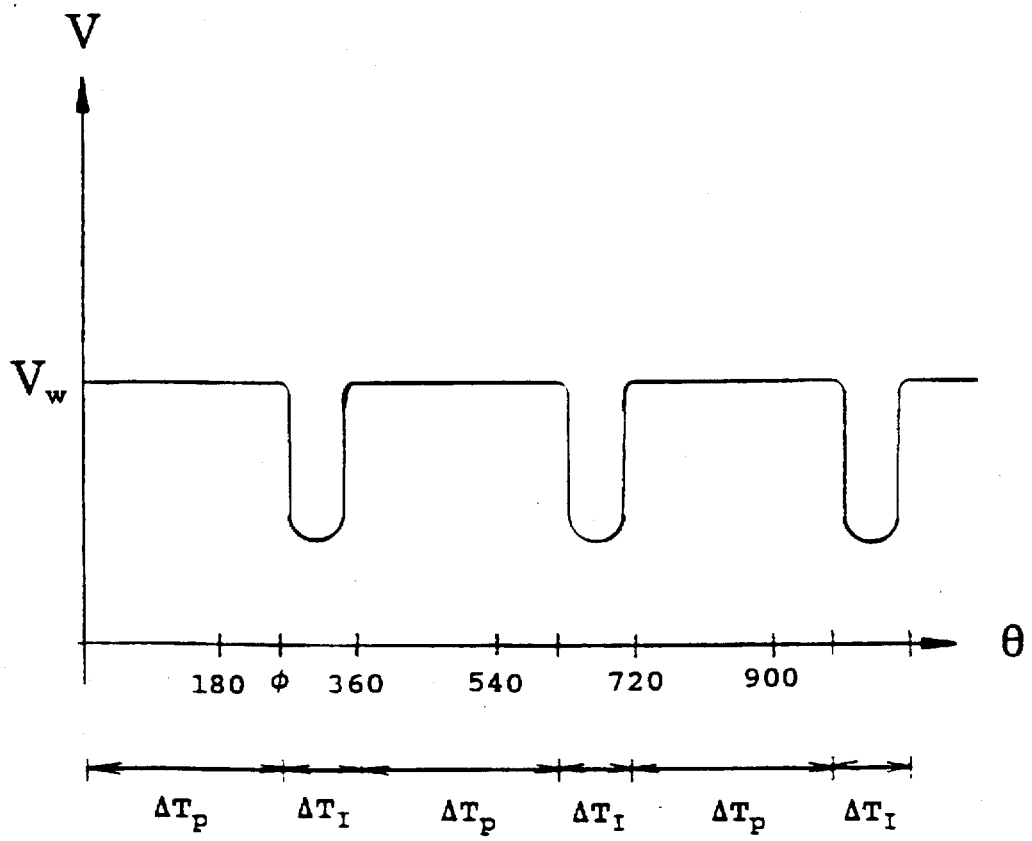
FIG. 2 is a graph showing the circumferential speed of a printing or punching plate mounted on a plate cylinder plotted as a function of the angular position of the cylinder and of the plate mounted thereon.

FIG. 2 shows the circumferential speed V of one of the printing plates 12 or 13 plotted against the angular position 8 of the plate mounted on the cylinder 16 or 17. $V_W$ indicates the speed of the web 10. During the time interval $\Delta T_P$ (printing or punching period) the plate is in contact with the web 10 and the circumferential speed of the plates 16 or 17 on the cylinder 12 or 13 is kept constant and equal to speed of the web 10 by the control device 22. During the time interval $\Delta T_I$ (idle period) the rotational speed of the plate cylinder 12 or 13 is changed (usually slowed down or stopped) while a part of the web 10 assigned to the format of the other plate cylinder passes. The rotational speeds of the cylinders 12 and 13 and the speed of the web 10 are calculated and controlled by the control device or controller 22 so that the leading edge of each of the plates 16 and 17 is brought into contact with the web 10 at or closely spaced from the position where the trailing edge of the other plate moves out of engagement with the web 10, and so that the circumferential speed of each of the plates 16 and 17 is the same as the speed of the web 10 when the plate is in engagement with the web. Information about parameters of the printing process necessary to control the operation as described above, such as lengths of the plates 16 and 17, diameters of the plate cylinders 12 and 13, thickness of the plates, desired spacing of adjacent formats 18, 19 to be printed on or punched from the web 10, etc., can be entered either manually via a console or keyboard 29, FIG. 1, or through a computer interface, not shown.

Each of the plate cylinders 12 and 13 may be mounted so as to be moveable transversely in relation to the path of the web, and such transverse movement may be controlled by the control device 22. In that case, each of the cylinders may be moved a small distance transversely away from the web path in the idle period $\Delta T_I$ and the rotational speed of the cylinder may at the same time be substantially increased so that the cylinder is rotated more than 360° in this idle period so as to position the leading edge of the printing plate in the correct position in relation to the web, and the cylinder may then be moved in a transverse direction back into its printing position. Furthermore, while the cylinder arrangement according to the invention comprises at least two plate cylinders, any higher number of plate cylinders may be used. In that case the first cylinder prints first formats which are mutually spaced at a distance which is sufficiently long to allow each of the remaining cylinders to print an additional respective format between each pair of successive first formats on the web.

What is claimed is:

1. A method of processing a continuous web (10) extending along a predetermined path by means of at least first and second printing or punching plates (16,17) mounted on first and second plate cylinders (12,13), respectively, mutually spaced along the length of said path, the first and second plates (16,17) each extending along only part of the circumferential length of the cylinder (12,13) on which it is mounted, said method comprising the steps of:

moving the continuous web (10) along said path at a substantially constant speed;

moving the first cylinder (12) such that the first printing or punching plate (16) mounted thereon is moved into and out of engagement with the moving web (10) so as to print or punch first formats (18) on the web (10) by means of the first printing or punching plate (16) such that the first formats (18) are mutually spaced in the direction of movement of the web (10);

moving the second cylinder (13) such that the second printing or punching plate (17) mounted thereon is moved into and out of engagement with the moving web (10) so as to print or punch second formats (19) on the web (10) in the spacings between said first formats (18) by means of the second printing or punching plate (17);

controlling the circumferential speed of the first and second plate cylinders (12,13) to be substantially equal to the moving speed of the web (10) while the first and second plates (16,17) respectively, mounted on said first and second cylinder (12,13) are in engagement with the web (10); and controlling the circumferential speed of the first and second plate cylinders (12,13) while the first and second plates (16,17), respectively, are out of engagement with the web (10) in such a way that the leading edge of the respective plate (16,17) comes into the correct angular position for engagement with the web (10) at the desired position in relation to the position where the trailing edge of the other plate (17,16) moves out of engagement with the web (10) to print or punch first and second formats one after the other on the web (10) with a desired mutual spacing.

2. A method according to claim 1, wherein the steps of controlling the circumferential speed of the first and second cylinders are performed so that the mutual spacing of the first formats (18) is substantially equal to the length of each second format (19) in the direction of movement of the web (10).

3. A method according to claim 1, wherein the steps of controlling the circumferential speed of the first and second cylinders are performed so that the length of the web (10) path section defined between the web (10) contact lines of the first and second plates (16,17) exceeds several times the combined length of the first and second formats (18,19).

4. A cylinder arrangement for a printing apparatus and for printing or punching on a continuous web (10) being moved at a substantially constant speed along a predetermined path defined in the apparatus, said arrangement comprising:

at least first and second plate cylinders (12,13) being arranged mutually spaced along the path of the web (10), each cylinder (12,13) being adapted to receive a printing or punching plate (16,17) extending along only part of the circumferential length of the cylinder (12, 13) between first and second peripheral positions thereof;

moving means for rotating the first and second cylinders (12,13) so as to move the plates (16,17) mounted thereon into and out of engagement with the moving continuous web (10); and control means for (a) controlling the moving means in such a way that first and second formats are printed or punched one after the other on the web (10) with a desired mutual spacing, and (b) controlling the circumferential speed of the first and second plate cylinders (12,13) so that the circumferential speed of the first and second plate cylinders (12,13) is substantially equal to the moving speed of the web (10) while the first and second plates (16,17), respectively mounted on said first and second cylinders, (12,13) are in engagement with the web (10), said control means further controlling the circumferential speed of the first and second plate cylinders so that the leading edge of the respective plate (16,17) of the first and second plate cylinders (12,13), while the first and second plates (16,17), respectively, are out of engagement with the web (10), comes into the correct angular position for engagement with the web (10) outside the format printed or punched by the other plate (17,16) and at the desired position in relation to the position where the trailing edge of the other plate (17,16) moves out of engagement with the web (10).

5. A cylinder arrangement according to claim 4, wherein the control means are adapted to control the moving means such that the first and second formats (18, 19) are printed or punched in closely adjacent relationship along the length of the web (10).

6. A cylinder arrangement according to claim 4, further comprising means for adjusting the length of the web (10) path section defined between the first and second cylinders (12, 13, 14, 15).

7. A cylinder arrangement according to claim 6, wherein the adjusting means comprise web (10) engaging means arranged between the first and second cylinders (12, 13, 14, 15) and being moveable transversely to the path of the web (10).

8. A cylinder arrangement according to claim 7, wherein the web (10) engaging means comprise a pair of rollers (27) defining part of the web (10) path therebetween.

* * * * *